US009599369B2

(12) United States Patent
Furmanek et al.

(10) Patent No.: US 9,599,369 B2
(45) Date of Patent: Mar. 21, 2017

(54) SYSTEMS AND METHODS FOR CONTROLLING GAS POWERED APPLIANCES

(71) Applicant: Emerson Electric Co., St. Louis, MO (US)

(72) Inventors: Daniel L. Furmanek, Ballwin, MO (US); Thomas P. Buescher, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 181 days.

(21) Appl. No.: 14/656,360

(22) Filed: Mar. 12, 2015

(65) Prior Publication Data

US 2016/0265811 A1 Sep. 15, 2016

(51) Int. Cl.
*F24H 9/20* (2006.01)
*F24H 1/18* (2006.01)

(52) U.S. Cl.
CPC ..... *F24H 9/2035* (2013.01); *F24H 1/186* (2013.01)

(58) Field of Classification Search
CPC ..... F24H 9/2035; F23N 2027/22; H01F 2007/1822; F02D 2041/2006
See application file for complete search history.

(56) References Cited

U.S. PATENT DOCUMENTS 4,131,413 A 12/1978 Ryno
4,696,639 A 9/1987 Bohan, Jr.
4,734,658 A 3/1988 Bohan, Jr.
4,770,629 A 9/1988 Bohan, Jr.
5,931,655 A 8/1999 Maher, Jr.
6,261,087 B1 * 7/2001 Bird ..... F23N 5/102 126/512
6,701,874 B1 3/2004 Schultz et al.
6,862,165 B2 3/2005 Chian et al.
6,920,377 B2 7/2005 Chian
6,955,301 B2 10/2005 Munsterhuis et al.
6,959,876 B2 11/2005 Chian et al.
7,170,762 B2 1/2007 Chian
7,252,502 B2 8/2007 Munsterhuis
7,317,265 B2 1/2008 Chian et al.

* cited by examiner

*Primary Examiner* — Jill Warden
*Assistant Examiner* — Matthew Krcha
(74) *Attorney, Agent, or Firm* — Armstrong Teasdale LLP

(57) ABSTRACT

A control system for controlling a gas powered water heater includes a thermoelectric generator to provide electrical power at a first voltage, a valve control system to selectively hold a main gas valve in an open position, a valve pick system to selectively pick the main gas valve from a closed position to the open position using the electrical power at the first voltage, and a power converter. The controller is electrically powered by a boosted electrical power at the second voltage from the power converter. The controller is communicatively coupled to the valve control system, the valve pick system, and the safety system. The controller is configured to control operation of the main burner and the main gas valve using the valve control system, the valve pick system, and the safety system to provide water heated to substantially a setpoint temperature.

18 Claims, 8 Drawing Sheets

SYSTEMS AND METHODS FOR CONTROLLING GAS POWERED APPLIANCES

FIELD

The field of the disclosure relates generally to gas powered appliances, and more particularly, to systems and methods for controlling operation of a gas powered water heater.

BACKGROUND

Storage water heaters may be utilized domestically and industrially in various applications. Domestically, a storage water heater is used for generation of hot water that may be used for bathing, cleaning, cooking, space heating, and the like.

A conventional gas fired water heater includes a water storage tank and gas fired burner assembly for heating water within the tank. In operation, combustion gases generated by the firing of the burner assembly may be directed upwardly through a flue pipe via a hood. The combustion gases serve to transfer heat to the water contained within the storage tank. The top of the water heater may include suitable fittings for connection to a supply of water and a water distribution system with a water inlet provided with a dip tube, which serves to direct the inflow of cold water to the bottom of the tank.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a control system for controlling a gas powered water heater to produce hot water in a storage tank by burning gas at a main burner is provided. The control system includes a thermoelectric generator to provide an electrical power output at a first voltage, a valve control system configured to be coupled to a main gas valve and to selectively hold the main gas valve in an open position using the electrical power at the first voltage to provide gas to a main burner, a valve pick system configured to be coupled to the main gas valve and to selectively pick the main gas valve from a closed position to the open position using the electrical power at the first voltage, a power converter coupled to the thermoelectric generator to produce a boosted electrical power at a second voltage greater than the first voltage, and a controller coupled to the power converter and electrically powered by the boosted electrical power at the second voltage. The controller is communicatively coupled to the valve control system and the valve pick system. The controller is configured to control operation of the main burner and the main gas valve using the valve control system and the valve pick system to provide water heated to a setpoint temperature.

In another aspect, a control system for controlling a gas powered water heater to produce hot water in a storage tank by burning gas at a main burner includes: a thermoelectric generator to provide an electrical power output at a first voltage, a valve control system configured to be coupled to a main gas valve and to selectively hold the main gas valve in an open position using the electrical power at the first voltage to provide gas to a main burner, a valve pick system configured to be coupled to the main valve to selectively pick the main gas valve from a closed position to the open position, a power converter coupled to the thermoelectric generator to produce a boosted electrical power at a third voltage greater than the first voltage, and a controller coupled to the power converter and electrically powered by the boosted electrical power at the third voltage. The valve pick system includes a pick capacitor. The valve pick system is configured to be coupled to receive the thermoelectric generator's electrical power output at the first voltage through the main gas valve and to charge the pick capacitor to a second voltage greater than the first voltage. The controller is communicatively coupled to the valve control system and the valve pick system. The controller is configured to control operation of the main burner and the main gas valve using the valve control system and the valve pick system to provide water heated to a setpoint temperature.

Another aspect is a water heater including a storage tank, a main burner configured to burn gas to heat water in the storage tank, a main gas valve coupled to the main burner and having an open position permitting gas flow through the main gas valve and a closed position preventing gas flow through the main gas valve, a pilot configured to ignite gas burned by the main burner, and a control system configured to control operation of the main burner and the pilot to provide water in the storage tank substantially at a setpoint temperature. The main gas valve includes an actuator coil. The control system includes a thermoelectric generator to provide an electrical power output at a first voltage, a valve control system coupled to the main gas valve and configured to selectively hold the main gas valve in an open position using the electrical power at the first voltage to provide gas to the main burner, a valve pick system coupled to the main valve to selectively pick the main gas valve from a closed position to the open position, a power converter coupled to the thermoelectric generator to produce a boosted electrical power at a third voltage greater than the first voltage, and a controller coupled to the power converter and electrically powered by the boosted electrical power at the third voltage. The valve pick system includes a pick capacitor. The valve pick system is configured to be coupled to receive the thermoelectric generator's electrical power output at the first voltage through the main gas valve and to charge the pick capacitor to a second voltage greater than the first voltage. The controller is communicatively coupled to the valve control system and the valve pick system. The controller is configured to control operation of the main burner and the main gas valve using the valve control system and the valve pick system to provide water heated to a setpoint temperature.

Yet another aspect of this disclosure is a water heater including a storage tank, a main burner configured to burn gas to heat water in the storage tank, a main gas valve coupled to the main burner and having an open position permitting gas flow through the main gas valve and a closed position preventing gas flow through the main gas valve, a pilot configured to ignite gas burned by the main burner, and a control system configured to control operation of the main burner and the pilot to provide water in the storage tank substantially at a setpoint temperature. The main gas valve includes an actuator coil. The control system includes a thermoelectric generator to provide an electrical power output at a first voltage, a valve control system coupled to a main gas valve and configured to selectively hold the main gas valve in an open position using the electrical power at the first voltage to provide gas to a main burner, a valve pick system coupled to the main gas valve and configured to selectively pick the main gas valve from a closed position to the open position using the electrical power at the first voltage, a power converter coupled to the thermoelectric generator to produce a boosted electrical power at a second voltage greater than the first voltage, and a controller coupled to the power converter and electrically powered by the boosted electrical power at the second voltage. The controller is communicatively coupled to the valve control system and the valve pick system. The controller is configured to control operation of the main burner and the main gas valve using the valve control system and the valve pick system to provide water heated to a setpoint temperature Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

The embodiments described herein generally relate to water heaters. More specifically, embodiments described herein relate to methods and systems for controlling operation of a gas powered water heater.

Figure 1:
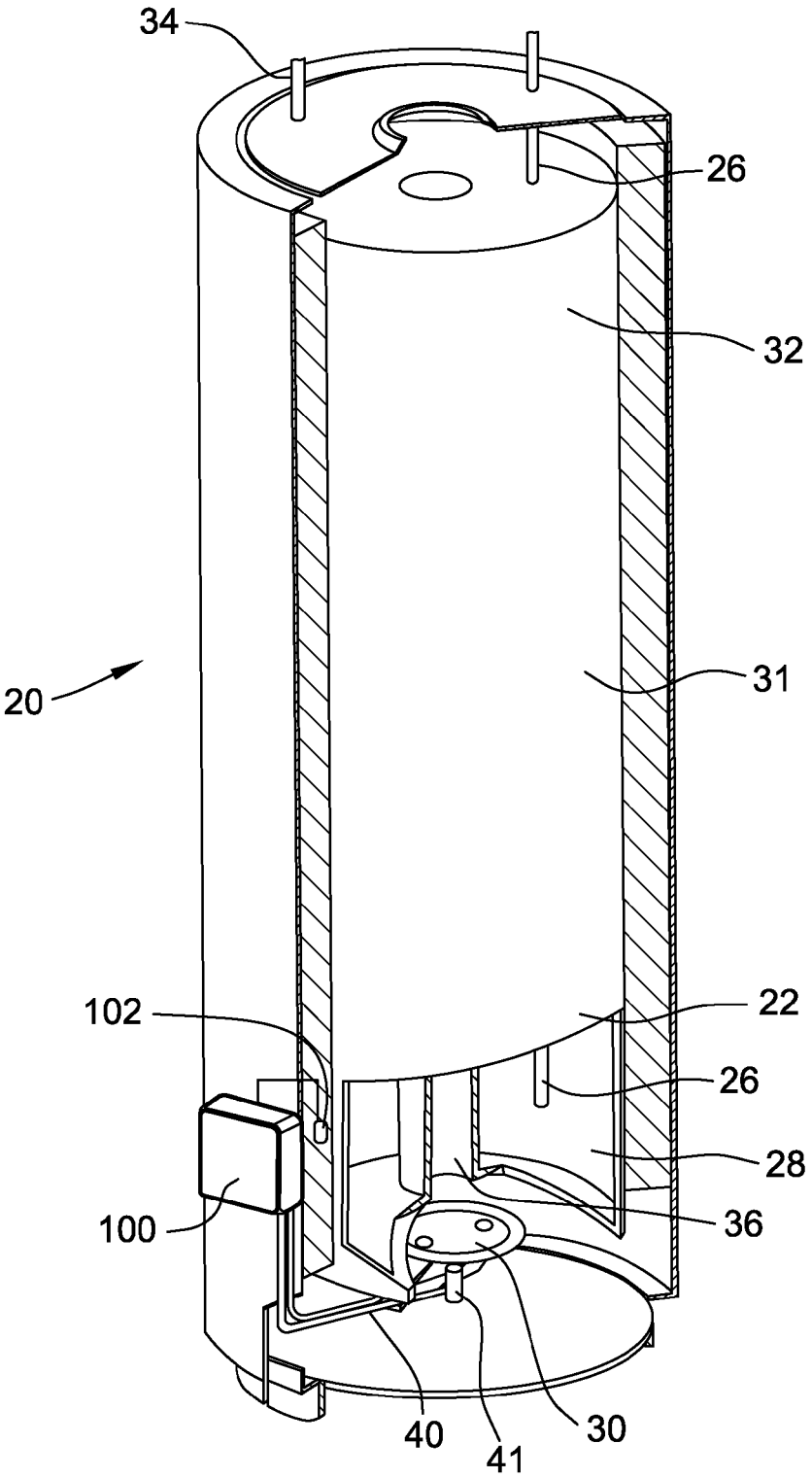
FIG. 1 is a cut-away view of a water heater including one embodiment of a control system for controlling operation of the water heater.

Referring initially to FIG. 1, a control system 100 is provided for controlling operation of a water heater 20 to maintain a desired temperature of water in the water heater 20. The water heater 20 has a storage tank 22 that stores heated water and receives cold water via a cold water inlet 26. Cold water entering a bottom portion 28 of the storage tank 22 is heated by a fuel-fired main burner 30 beneath the storage tank 22. Water leaves the storage tank 22 via a hot water outlet pipe 34. Combustion gases from the main burner 30 leave the water heater 20 via a flue 36. The control system 100 provides for control of gas flow via a gas supply line 40 and one or more valves (not shown) to the main burner 30, as described herein. The gas burned by the water heater 20 may be natural gas, liquid propane (LP) gas, or any other suitable gas for powering a water heater. Moreover, the control system 100 controls a standing (i.e., continuously lit) pilot burner 41 that operates as an ignition source for the main burner 30. The control system 100 also controls gas flow via gas line 40 and one or more valves (not shown in FIG. 1) to the pilot burner 41. Alternatively, the ignition source may be a piezoelectric lighter or any other suitable ignition source. In some embodiments, a piezoelectric lighter is used to ignite the pilot burner 41.

The control system 100 includes a sensor 102 that provides an output or value that is indicative of a sensed temperature of the water inside of the storage tank 22. For example, the sensor 102 may be a tank surface-mounted temperature sensor, such as a thermistor. Alternatively, in other embodiments, the sensor 102 may be a temperature probe or any other sensor suitable for measuring the water temperature in storage tank 22. In the embodiment shown in FIG. 1, sensor 102 is positioned proximate bottom portion 28 of the storage tank 22. Alternatively, the sensor 102 may be positioned to detect the temperature of the water in the storage tank 22 at any other suitable portion or portions of the storage tank, such as a middle portion 31, an upper portion 32, or a combination of bottom, middle, and/or upper portions. Moreover, the control system 100 may include more than one sensor 102. For example, the control system 100 may include two or more temperature sensors 102 for detecting the water temperature at one or more locations in the storage tank 22. In one example, the control system 100 include two sensors 102 that are thermistors mounted on a circuit board positioned within a watertight tube near the bottom of the storage tank 22. The two thermistors detect the temperature of the water near the bottom portion 28 of the storage tank 22.

The control system 100 is positioned, for example, adjacent the storage tank 22. Alternatively, the control system 100 is located underneath the storage tank 22, in a watertight compartment within the storage tank 22, or in any other suitable location. Sensor 102 is in communication with control system 100, and provides control system 100 an output or value indicative of the water temperature in storage tank 22. In some embodiments, a second sensor (not shown) may be disposed at an upper portion 32 of the water heater 20, to provide an output or value that is indicative of a sensed temperature of the water in upper portion 32 of storage tank 22.

Various embodiments of the control system 100 may include and/or be embodied in a computing device. The computing device may include, a general purpose central processing unit (CPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. Such instructions, when executed by a processor, cause the processor to perform at least a portion of the methods described herein.

Figure 2:
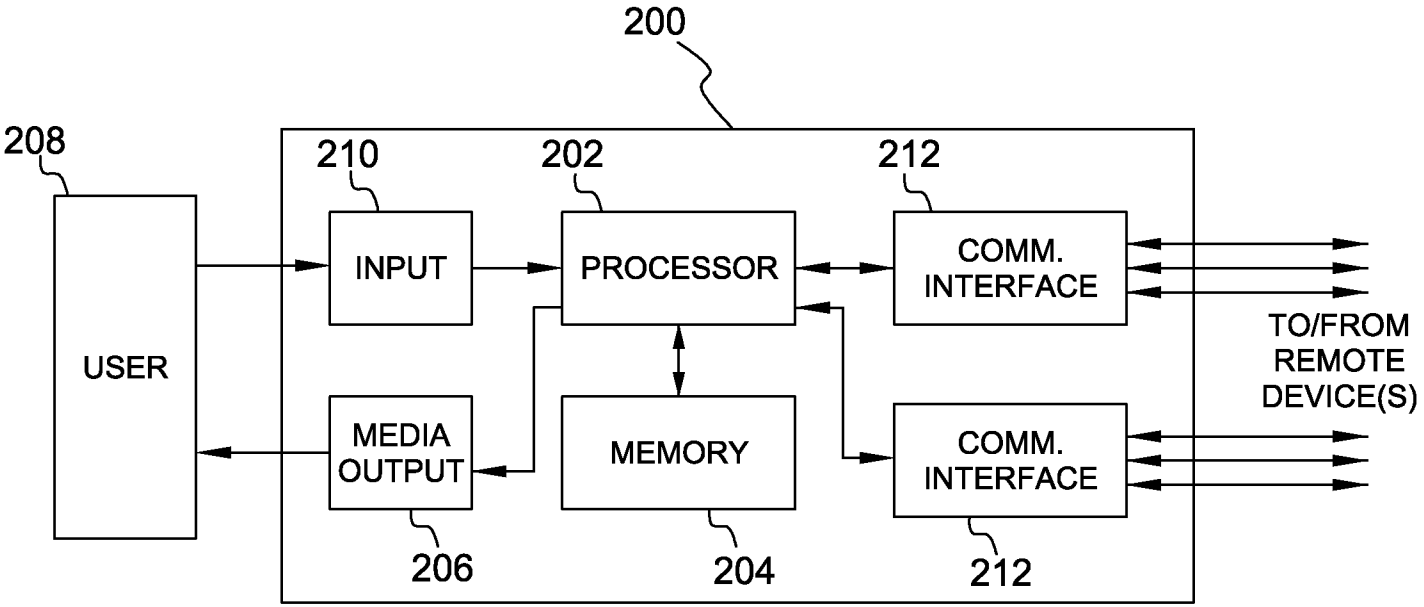
FIG. 2 is a block diagram of a computing device for use in the water heater shown in FIG. 1.

FIG. 2 is an example configuration of a computing device 200 for use in the control system 100. The computing device 200 includes a processor 202, a memory area 204, a media output component 206, an input device 210, and communications interfaces 212. Other embodiments include different components, additional components, and/or do not include all components shown in FIG. 2.

The processor 202 is configured for executing instructions. In some embodiments, executable instructions are stored in the memory area 204. The processor 202 may include one or more processing units (e.g., in a multi-core configuration). The memory area 204 is any device allowing information such as executable instructions and/or other data to be stored and retrieved. The memory area 204 may include one or more computer-readable media.

The media output component 206 is configured for presenting information to user 208. The media output component 206 is any component capable of conveying information to the user 208. In some embodiments, the media output component 206 includes an output adapter such as a video adapter and/or an audio adapter. The output adapter is operatively coupled to the processor 202 and operatively coupleable to an output device such as a display device (e.g., a liquid crystal display (LCD), organic light emitting diode (OLED) display, cathode ray tube (CRT), or "electronic ink" display) or an audio output device (e.g., a speaker or headphones).

The computing device 200 includes, or is coupled to, the input device 210 for receiving input from the user 208. The input device is any device that permits the computing device 200 to receive analog and/or digital commands, instructions, or other inputs from the user 208, including visual, audio, touch, button presses, stylus taps, etc. The input device 210 may include, for example, a variable resistor, an input dial, a keyboard/keypad, a pointing device, a mouse, a stylus, a touch sensitive panel (e.g., a touch pad or a touch screen), a gyroscope, an accelerometer, a position detector, or an audio input device. A single component such as a touch screen may function as both an output device of the media output component 206 and the input device 210.

The communication interfaces 212 enable the computing device 200 to communicate with remote devices and systems, such as sensors, valve control systems, safety systems, remote computing devices, and the like. The communication interfaces 212 may be wired or wireless communications interfaces that permit the computing device to communicate with the remote devices and systems directly or via a network. Wireless communication interfaces 212 may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Wash.; ZigBee is a registered trademark of the ZigBee Alliance of San Ramon, Calif.) Wired communication interfaces 212 may use any suitable wired communication protocol for direct communication including, without limitation, USB, RS232, I2C, SPI, analog, and proprietary I/O protocols. Moreover, in some embodiments, the wired communication interfaces 212 include a wired network adapter allowing the computing device to be coupled to a network, such as the Internet, a local area network (LAN), a wide area network (WAN), a mesh network, and/or any other network to communicate with remote devices and systems via the network.

The memory area 204 stores computer-readable instructions for control of the water heater 20 as described herein. In some embodiments, the memory area stores computer-readable instructions for providing a user interface to the user 208 via media output component 206 and, receiving and processing input from input device 210. The memory area 204 includes, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory usable for storage of a computer program.

Figure 3:
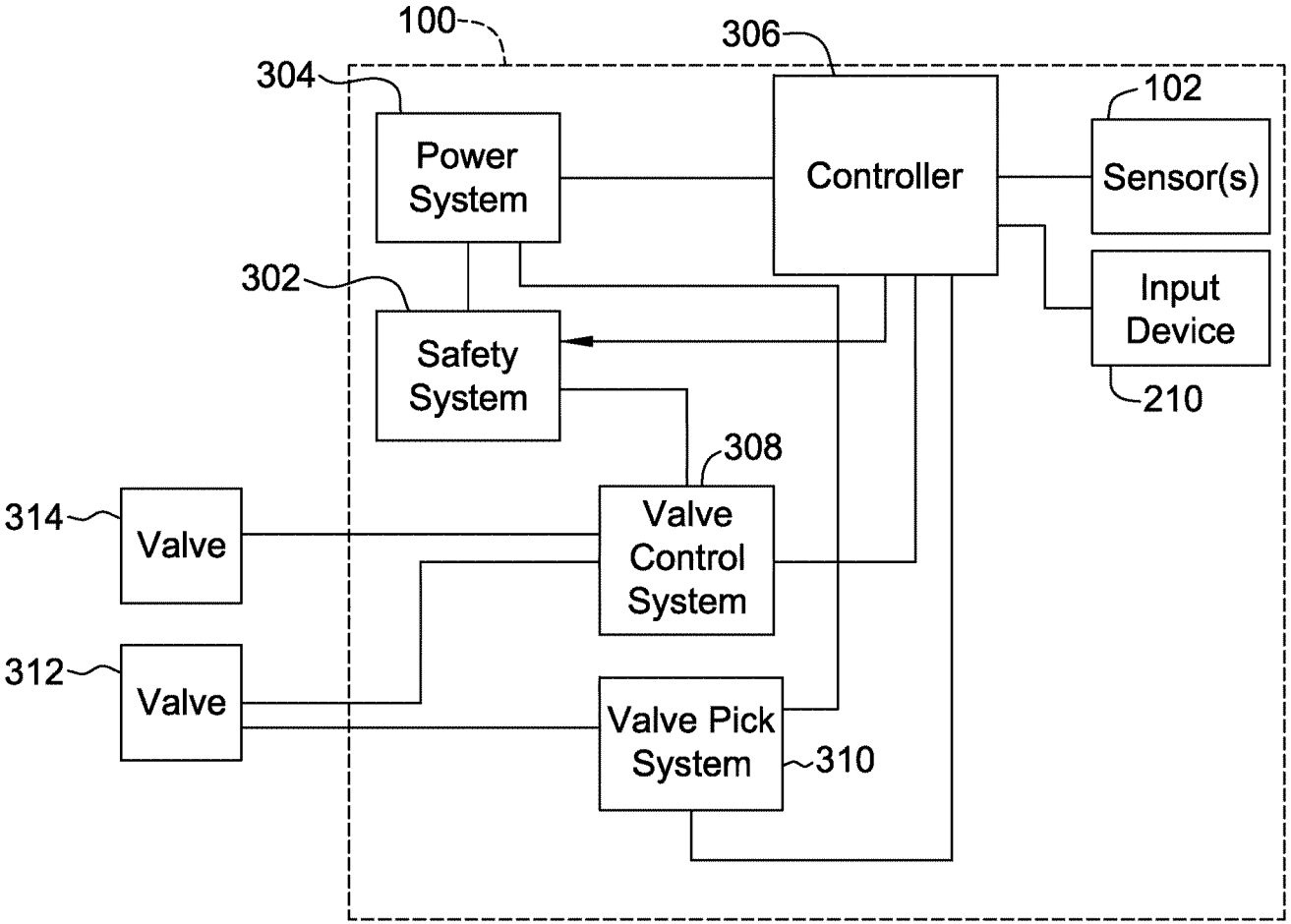
FIG. 3 is a schematic block diagram of the control system shown in FIG. 1.
Figure 4:
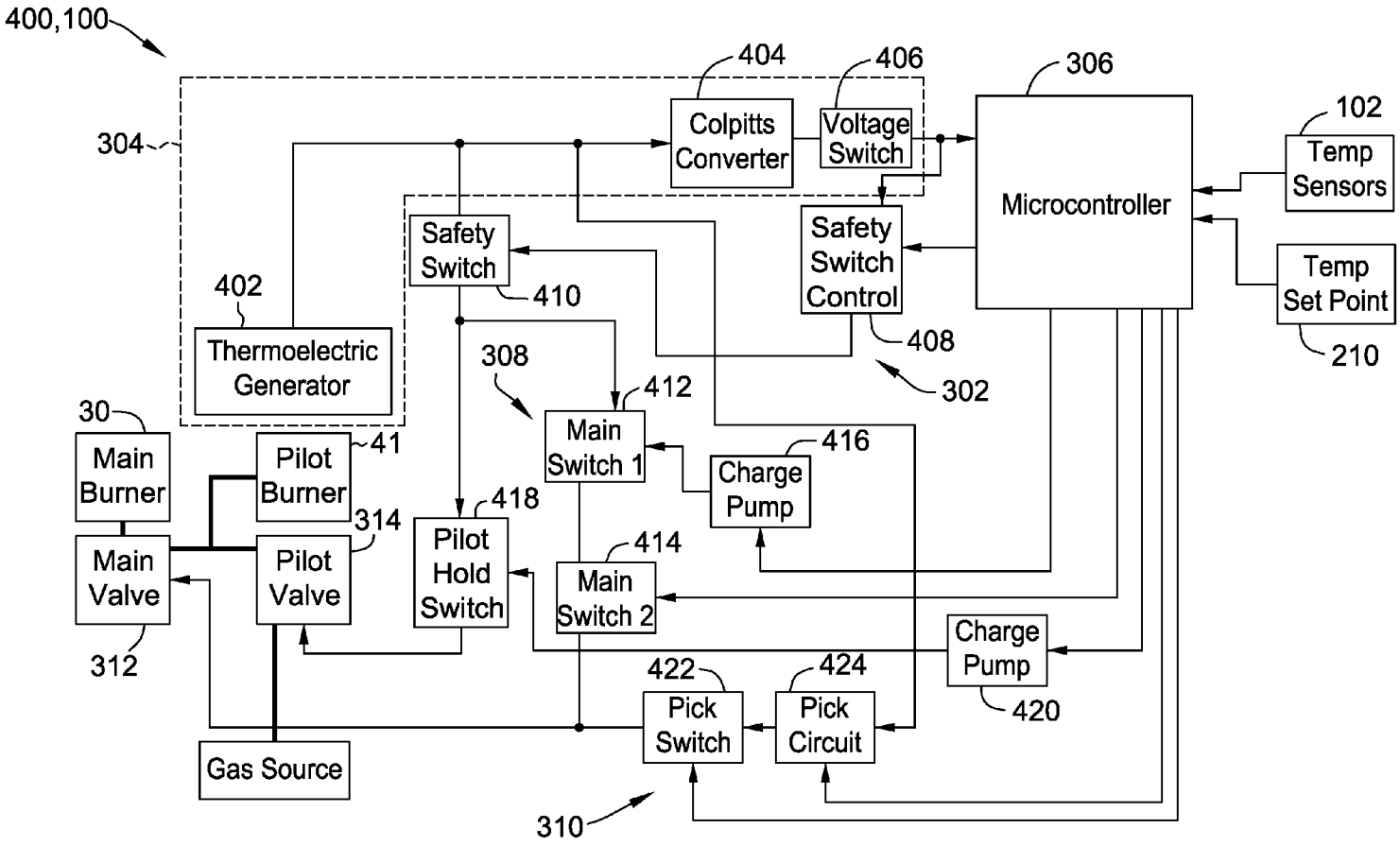
FIG. 4 is a schematic block diagram block of an embodiment of the control system shown in FIG. 3.

A functional block diagram of the control system 100 is shown in FIG. 3. The control system includes a safety system 302, a power system 304, a controller 306, sensors 102, a valve control system 308, and a valve picking system 310. The control system is coupled to and controls a first valve 314 and a second valve 312. The second valve 312 and the first valve 314 are solenoid actuated gas valves for selectively coupling gas to the main burner 30 and the pilot burner 41, respectively. An electrical current through the coil of the valve 312 or 314 causes the valve 312 or 314 to open. As shown in FIG. 4, gas flows from a gas source to first valve 314. Gas that passes through the first valve 314 is provided to the pilot burner 41 and the second valve 312. Gas passing through the second valve 312 is provided to the main burner 30.

With reference again to FIG. 3, the power system 304 provides power to the other components of the control system 100. Specifically, the power system 304 provides power to the controller 306, the valve control system 308, and the valve pick system 310. The power system 304 provides an output to the valve control system 308 and the valve pick system 310 at a first voltage that is lower than a second voltage output to the controller 306. The power system 304 may include and/or receive power from any suitable alternating current (AC) or direct current (DC) power source, such as one or more batteries, thermoelectric generators, photovoltaic cells, AC utilities, and the like. In an example embodiment, the power system includes an unregulated DC power source (not shown in FIG. 3) with a source resistance between about two and five ohms. In some embodiments, the unregulated DC power source is a thermoelectric generator in thermal communication with the pilot burner 41. The thermoelectric generator can be represented by an 850 mV Thevenin equivalent voltage source with a 4.8 ohm Thevenin equivalent source resistance. In other embodiments, the thermoelectric generator may be represented by a 0.650 to 1.200 V voltage source with a 2 to 6 ohm source resistance.

The safety system 302 is configured to selectively extinguish and/or prevent ignition of the main burner 30 and/or the pilot burner 41. Specifically, the safety system 302, under the direction of the controller 306, prevents the power system from providing sufficient voltage, current, and/or power to hold open the first valve 314 or the second valve 312. When the valves 312 and 314 are closed, gas flow to the main burner 30 and the pilot burner 41 is prevented and ignition of the main burner 30 and the pilot burner 41 is thereby prevented. When the controller 306 determines to shut down the water heater 20 using the safety system 302, the controller 306 outputs a signal to safety system 302. In response to the signal, the safety system 302 causes the valves 312 and 314 to close (if open) and prevents them from being opened (if already closed). In other embodiments, the safety system 302 operates in response to a lack of an expected signal from the controller 306. Thus, if the controller does not send (or the safety system 302 otherwise does not receive) the expected signal, whether continuously or periodically, the safety system 302 causes the valves 312 and 314 to close.

Responsive to signals from the controller 306, the valve control system 308 selectively couples power from the power system 304 to the valves 312 and 314 to selectively hold them open. The valve control system 310 is responsive to signals from the controller 306 to couple power to one of the valves 312 or 314 and to signals that instruct it to decouple the valve 312 or 314 from the power system 304. Moreover, when the valve control system is holding one of the valves 312 or 314 open, the valve control system 308 ceases coupling power to the valves 312 and 314 if it does not receive an expected signal from the controller 306. Thus, if the controller 306 stops sending the expected signal (or sends an incorrect signal) the valve control system decouples the valve(s) 312 and/or 314 from the power system 304, thereby causing the valves 312 and/or 314 to close. The expected signal may be a continuous signal, a signal repeated at a particular interval, a signal with a particular duty cycle or frequency, or any other suitable signal.

The valve pick system 310 receives power at the first voltage directly from the power system 304. In other embodiments, the safety system 302 is disposed between the power system 304 and the valve pick system 310. The valve pick system 310 opens (also sometimes referred to as "picking" or "picking open") the main valve 312 when commanded to do so by the controller 306. The valve pick system 310 does not open the pilot valve 314. The pilot valve 314, in this embodiment, is a manually opened valve, which may be held open by the valve control system 308 after it is manually opened. Alternatively, the valve pick system 310 may also be operable to pick the pilot valve 314.

The sensors 102 are temperature sensors operable to provide a signal indicative of the temperature the water in the storage tank 22. The sensors 102 provide their signals to the controller 306. As described above, the sensors 102 are any suitable sensor, such as thermistors, probes, and the like, for detecting the temperature of the water within the storage tank. Additionally, or alternatively, the sensors 102 may include any other suitable types of sensors, such as oxygen sensors, ambient air temperature sensors, moisture sensors, etc.

The controller 306 controls operation of the water heater 20 and the control system 100. The controller 306 operates the water heater to provide water heated to a desired temperature, such as a temperature setpoint that is set by a user via the input 210. The controller 306 includes a computing device, such as computing device 200. In some embodiments, the controller 306 is a microcontroller. Alternatively, the controller 306 includes any combination of digital and/or analog circuitry that permits the controller 306 to function as described herein.

In general, the controller 306 controls the water heater 20 based on the inputs from the sensors 102 and the temperature setpoint. Under normal operations, the controller 306 utilizes the valve control system 308 to hold open the pilot valve 314 to permit gas to flow to the pilot burner 41 and the main valve 312 When the water temperature detected by the sensors 102 drops below the a threshold slightly below the temperature setpoint, the controller 306 opens the main valve 312 using the valve pick system 310. After the main valve 312 is picked open, the controller 306 holds the main valve open by coupling power from the power system 304 to the main valve 312 through the valve control system 308. When the controller 306 determines, based on the temperature set point and the input from the temperature sensors 102, to turn off the main burner 30, it decouples the main valve 312 from the power system 304 to close the main valve 312, thereby interrupting the flow of gas to the main burner 30 and extinguishing the main burner 30. If an abnormal condition occurs at any point during operation, the safety system prevents the power system 304 from opening and/or holding open the valves 312 and 314.

FIG. 4 is a block diagram of an example embodiment 400 of the control system 100 shown in FIG. 3.

The power system 304 includes a thermoelectric generator 402, a power converter 404, and a voltage switch 406. The thermoelectric generator 402 is thermally coupled to the pilot burner 41. The thermoelectric generator 402 provides a direct current (DC) electrical output (voltage V1) in response to a flame on the pilot burner 41. Although the output voltage V1 will vary based on load, temperature, and other factors, under steady state conditions the voltage V1 will be around 850 mV open source and around 450 mV with controller 306 powered and the coil of pilot valve 314 powered. The output of the thermoelectric generator 402 is input to the power converter 404. The power converter 404 is a Colpitts type oscillator that is self-starting and self-oscillating. The converter 404 automatically begins operating in response to the electrical output from the thermoelectric generator 402. The power converter 404 produces a DC output with a voltage (V2) greater than its input voltage V1. In an example embodiment, the maximum value of voltage V2 output by the converter 404 varies between about seventeen times V1 to about ten times V1 depending on the magnitude of the voltage V1 input to the converter 404. In other embodiments, the maximum voltage V2 may have any other suitable relationship or range of relationships to the voltage V1. At steady state, the converter 404 will provide an output voltage of approximately 5 volts. When the voltage V2 is coupled to the controller 306, the controller 306 turns on and begins controlling operation of the water heater 20.

The control system 100 includes a flame loss feedback safety feature. The thermoelectric generator's thermal communication with the pilot burner 41 produces the current to hold open the pilot valve 314. If the flame on the pilot burner 41 is lost, the output voltage from the thermoelectric generator 402 will decrease until there is insufficient current to hold open the pilot valve 314. Because gas flows through the pilot valve 314 to the main valve 312 (and the main burner 30), the loss of flame on the pilot burner 41 causes the pilot valve 314 to close and interrupt gas flow to both the pilot burner 41 and the main burner 30. This may help prevent gas from being delivered to the pilot burner 41 or the main burner 30 when there is no ignition source available for the gas.

The voltage switch 406 is located between the converter 404 and the controller 306. The voltage switch 406 defaults to an OFF (non-conducting) state and turns ON when its supply voltage (i.e., the output of converter 404) reaches a first threshold. The voltage switch 406 also turns OFF if its supply voltage falls below a second, lower threshold. The voltage switch 406 selectively connects the voltage V2 to the controller 306 to power the controller 306. At startup, the thermoelectric generator 402 output V1 will be zero and it will ramp toward its steady state value over several minutes. When voltage V1 reaches approximately 50-100 mV, the power converter 404 will turn on and its output voltage V2 will begin ramping toward its steady state value of 5V. The ramp to 5V can take 30-60 seconds depending on the V1 ramp rate. When the converter 404 output voltage V2 reaches the first threshold, the voltage switch 406 turns ON and the power supply voltage of the controller 306 will immediately rise to a voltage substantially equal to the first threshold. The voltage output from the voltage switch 406 will be slightly less than the voltage V2 because there is a small voltage drop across the voltage switch 406. The voltage drop depends on the particular device used for the voltage switch 406 and the ambient temperature. In an example embodiment, the voltage drop is between about 0.1 volts and 0.2 volts. This provides a "hard-edge" to the controller 306 power supply pin and other systems that use the controller 306 power supply voltage. The voltage switch 406 also provides a reference for software timings as the software can assume the supply voltage of the controller 306 is roughly equal to the first threshold at the start of code execution. The voltage switch 406 includes hysteresis so that it will not turn OFF if the voltage V2 falls back below the first threshold value. The OFF threshold for the voltage switch 406 is set to a second, lower threshold value that is below the brown-out voltage for the controller 306. In the example embodiment, the first threshold value is about 3.5 volts, the brownout voltage of the controller 306 is about 1.8 volts, and the second threshold value is less than 1 volt. If V2 drops below 1.8V, the controller 306 will brown-out before the voltage switch 406 turns off. Alternatively, the second threshold may be a value that is not below the brown-out voltage of the controller 306. For example, the second threshold voltage may be set at 2.5V. The voltage V2 could then vary between 5 volts and 2.5 volts without the voltage switch 406 turning off. Because the second threshold is above the brownout voltage, the voltage switch 406 will be turned off by a decreasing voltage V2 before the brown-out voltage of the controller 306 is reached.

The safety system 302 includes a safety switch control circuit 408 and a safety switch 410. The safety switch 410 is connected between the thermoelectric generator 402 and the valve control system 308 to selectively interrupt current flow to the valve control system 308. The safety switch control circuit 408 is coupled to the output of the voltage switch 406, the safety switch 410, and a control pin of the controller 306. The pin of the controller 306 that is coupled to the safety switch control circuit 408 is driven high or low to turn the safety switch 410 on or off. When the safety switch 410 is on/closed, the thermoelectric generator 402 is connected to the valve control system 308 and the valve control system 308 may receive power from the thermoelectric generator 402. When the safety switch 410 is off/open, the thermoelectric generator 402 is disconnected from the valve control system 308 and the valve control system 308 cannot receive power from the thermoelectric generator 402. In some embodiments, the safety switch control circuit 408 includes a timer circuit that requires periodic action by the controller 306 to prevent the safety switch control circuit 408 from turning off the safety switch 408.

In other embodiments, the safety switch 410 is coupled between the output of the thermoelectric generator 402 and ground (and is not coupled to the valve control system 308). The thermoelectric generator 402 is an unregulated DC power source that can be represented by an 850 mV Thevenin equivalent voltage source with a 4.8 ohm source resistance at optimal steady state. In some embodiments, the thermoelectric generator 402 is represented by a 650 mV to 1.2 V Thevenin equivalent voltage source with a 2 to 6 ohm source resistance at optimal steady state.

The Thevenin equivalent voltage generally decreases as ambient temperature around the generator 402 increases, such as after the main burner 30 has been on for a long time. Because of the thermoelectric generator 402 power supply characteristics, the size of its load (in ohms) will determine the voltage over the load. Substantially lowering the overall load on the thermoelectric generator 402, by switching in a parallel low resistance load (not shown) or shorting directly to ground via the safety switch 410, substantially lowers the voltage (V1) because of the voltage divider created with the source resistance and the new lower overall load. The safety switch 410 load is sized so that when it is switched on it will lower the voltage V1 below the voltage required to hold open the valves 312 and 314 and below the voltage required to start the converter 404. Moreover, the size of the safety switch load (and its presence or absence) is determined according to the source impedance of the power source. If the source impedance of the power source is relatively low, the safety switch load should be greater than 0 ohms to limit the current and drop the output voltage substantially across the safety switch load. In the example embodiment, the safety switch 410 load is sized to drop the load resistance to about 0.24 ohms and the voltage V1 drops to about 40 mV. Alternatively, because the thermoelectric generator 402 has a relatively high source impedance, the safety switch 410 couples the output of the thermoelectric generator 402 directly to ground without inclusion of a parallel low resistance load. In one example, the safety switch 410 load is sized to drop the load resistance to about 0 ohms and the voltage V1 to between about 10 mV and about 15 mV. In such embodiments, the pin of the controller 306 that is coupled to the safety switch control circuit 408 is held in a high impedance (Hi-Z) state at startup. The safety switch control circuit 408 includes a timing circuit, e.g., an RC circuit defining an RC time constant, that is enabled by placing the controller 306 pin in the Hi-Z state. When the voltage switch 406 turns on, the safety switch control circuit 408 will slowly charge toward the voltage V2. If the voltage of the safety switch control circuit 408 reaches a threshold value, the safety switch control voltage will cause the safety switch 410 to turn on. When the safety switch 410 is turned on, the thermoelectric generator output is substantially shorted to ground and there is insufficient power available to hold open the main valve 312, hold open the pilot valve 314, operate the converter 404, and operate the controller 306. If the pin of the controller 306 that is coupled to the safety switch control circuit 408 is switched to a logical low state before the safety switch control circuit 408 reaches the threshold value, the timing circuit is disabled and the safety switch 410 does not turn on. In normal startup operation, the controller 306 will change the output of its safety switch control pin to a low state within a preset amount of time, preventing the voltage of the safety switch control circuit 408 from reaching the threshold to turn on the safety switch 410. The controller 306 changes the output of the safety switch pin to a low state after the controller 306 passes all internal microprocessor and hardware checks (internal microprocessor checks can take from 4 to 6 seconds after the voltage switch 406 turns on and the controller 306 begins executing instructions). In embodiments in which the safety switch control circuit 408 is not coupled to the voltage switch 406, the safety switch control pin begins in the low state during normal startup operations. During normal operation of the water heater 20, the controller 306 will maintain the output pin coupled to the safety switch control circuit 408 in a low state, thus keeping the voltage of the safety switch control circuit 408 from reaching the threshold to turn on the safety switch 410. If the controller 306 determines to shut the valves 312 and 314 of the water heater 20 for safety reasons, the controller 306 switches the safety circuit output pin to a high state. When the output pin is high, the safety switch circuit 408 charges to the threshold to turn on the safety switch 410 at a rate that is faster than the rate when the pin is in the Hi-Z state. In some embodiments, the controller also sets the safety switch enable pin to a high impedance state (thus allowing the safety switch control voltage to charge) before providing signals to hold open the valves 312 and 314. The safety switch enable pin is then driven low once the signals are completed. In this way if the controller 306 malfunctions and becomes stuck in the state when signaling to the valves is ON, the safety switch 410 will eventually charge and shut the system down.

The valve control system 308 includes a first main switch 412, a second main switch 414, a main charge pump 416, a pilot switch 418, and a pilot charge pump 420. As described above, the controller 306 selectively holds open the main valve 312 and the pilot valve 314 via the valve control system 308, which may also be referred to as a valve holding system. The controller 306 holds the pilot valve 314 open by closing the pilot hold switch 418 to couple the pilot valve 314 to the thermoelectric generator 402 output. Specifically, the controller 306 supplies periodic bursts of pulse width modulated (PWM) signals to the pilot charge pump 420. The PWM signals are square waves with an amplitude that switches from 0 volts to substantially the voltage V2. The burst of PWM signals charge the pilot charge pump 420 to a voltage V3 sufficient to turn on the pilot switch 418. In the exemplary embodiment, the voltage V3 is less than the voltage V2. The magnitude of the voltage V3 will vary with the varying of voltages V1 and V2. When the voltage V2 is about 5 volts, the exemplary voltage V3 will be about 3 volts. In other embodiments, the voltage V3 may be the same as or greater than the voltage V2 depending on the voltage needed to turn on the pilot switch 418. In one embodiment, V3 is about 3.25 volts. The controller 306 periodically provides PWM signal bursts to maintain the output of the charge pump at about V3. If the controller 306 ceases providing the PWM signal bursts or delays too long before providing a burst, the charge pump will not output a voltage V3 sufficient to turn on the pilot switch 418. The pilot switch 418 will turn off (or stay off), the pilot valve 314 will be closed, the pilot burner 41 will not receive gas through the pilot valve 314, and the pilot burner 41 will be extinguished. A generally similar control procedure is used to hold open the main valve 312 using the first main switch 412 and the main charge pump 416. The addition of the second main switch 414 and the pick circuit 310 change the operation as described below.

The valve pick system 310 includes a pick switch 422 and a pick circuit 424. The pick circuit 424, the pick switch 422, and both main valve switches 412 and 414 are utilized for picking open the main valve 312. The controller selectively couples the voltage V1 from the thermoelectric generator 402 to the pick circuit 424 to charge a pick circuit capacitor (not shown) to, ideally, the voltage V1. In reality, the pick circuit capacitor may be charged to a voltage that is slightly less than V1. The pick circuit capacitor will take time to charge. The controller 306 monitors the voltage of the pick capacitor. When the pick capacitor is charged to a voltage greater than a picking threshold voltage, the controller 306 may pick open the main valve 312. The picking threshold voltage is less than the voltage V1, but more than the minimum voltage needed to open the main valve 312. In one example, the minimum voltage needed to open the main valve 312 is about 225 mV. In other examples, the minimum voltage to open the main valve 312 is any value between about 200 mV and 250 mV. To pick the main valve, the controller 306 sends a burst of PWM signals to the main charge pump 416 to charge the charge pump 416 to a voltage V4 sufficient to turn on the first main switch 412. In the example embodiment, the magnitude of the voltage V4 will vary with the varying of voltages V1 and V2. For example, when the voltage V2 is about 5 volts, the voltage V4 will be about negative 2 volts. In another embodiment, the voltage V4 will be about negative 3.15 volts. In other embodiments, the voltage V4 is any other voltage suitable for turning on the first main switch 412. The controller 306 periodically provides PWM signal bursts to maintain the output of the main charge pump 416 at about V4. If the controller 306 ceases providing the PWM signal bursts or delays too long before providing a burst, the main charge pump 416 will not output a voltage V4 sufficient keep the first main switch 412 turned on. The second main switch 414 is initially off. After the first main switch 412 is turned on, the controller 306 turns the pin connected to the pick switch 422 to a high output in order to activate the pick switch 422. The energy stored in the pick circuit capacitor is coupled to the main valve 312 through the pick switch 422 and the main valve 312 opens. The second main switch 414 is closed briefly before the pick switch 422 is opened. Closing the second main switch 414 couples the thermoelectric generator 402 voltage V1 to the main valve 312 through the first and second main switches 412 and 414 to hold the main valve 312 open so the main burner 30 remains lit. To keep the main burner 30 lit, the controller 306 keeps the main switches 412 and 414 on by maintaining the output pin coupled to the second main switch 414 high and periodically sending bursts of PWM signals to the main charge pump 416. To turn off the main burner 30, the controller 306 opens both main switches 412 and 414, thereby interrupting the connection between the main valve 312 and the thermoelectric generator 402.

Figure 5:
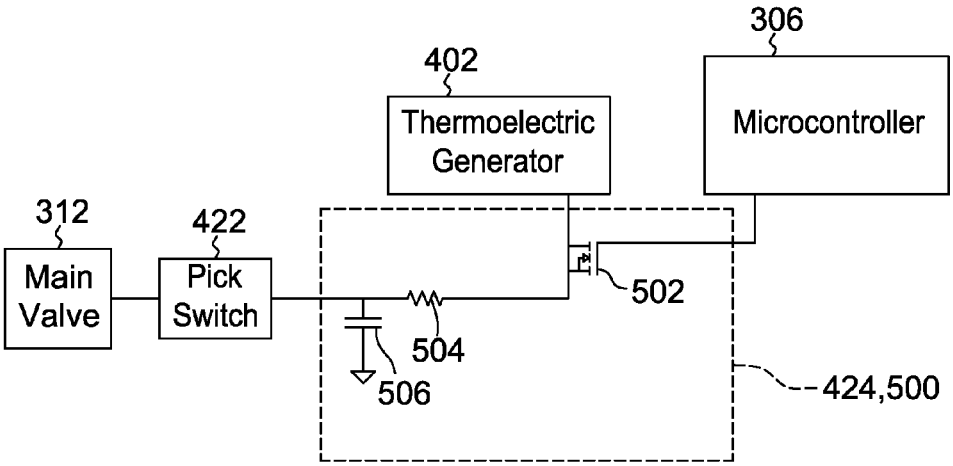
FIG. 5 is a partial circuit diagram of pick circuit for the control system shown in FIG. 4.

FIG. 5 is a partial circuit diagram including an example embodiment of a pick circuit 500 for use as the pick circuit 424 in the system 100 shown in FIG. 4. The pick circuit 500 includes a pick charging switch 502, a resistor 504, and a pick capacitor 506. The pick charging switch 502 is an N-channel MOSFET. Alternatively, the pick charging switch 502 is a P-channel MOSFET, an IGBT, a bipolar transistor, or any other switch suitable for operation as described herein. The controller 306 selectively turns on/closes the pick charging switch 502 to couple the output of the thermoelectric generator 402 to the pick capacitor 506 via the resistor 504. The example pick capacitor 506 is a 6800 microfarad capacitor. Alternatively, the pick capacitor 506 may have any capacitance sufficient to store enough energy to pick open main valve 312. Generally, the pick capacitor 506 is sized based on the minimum picking voltage. The picking force generated to pick open main valve 312 increases as the voltage increases and increases as the capacitor size increases. Some of the properties of the actuator of the main valve 312 also affect the capacitor selection. The distance the actuator has to move is called the stroke. The smaller the stroke, the smaller the pick capacitor and/or the voltage needed. Main valve 312 includes an opposing spring that mechanically closes the valve 312 when it isn't being held open by the controller 306. If the spring force is small, less voltage and/or a smaller pick capacitor 506 is needed. After the minimum spring size and minimum stroke are selected, the pick capacitor 506 can be selected. The size of the pick capacitor 506 can be calculated by solving the RLC circuit including the pick capacitor 506 and the actuator coil (not shown in FIG. 5) of main valve 312 for current, and calculating the magnetic force based on the current. Changes from a known system may be calculated by shifting each component by the same factor. For example, a known system uses a 680 uF cap charged to 3V and discharged through an inductive coil. A 6800 uF pick capacitor (i.e., ten times the size of the 680 uF capacitor) charged to 300 mV (one tenth the 3V) will produce approximately the same picking force when discharged through a similar coil having a coil resistance and coil inductance reduced by ten times as compared to the first coil.

The second main switch 414 is used in both picking and holding open the main valve 312 and can be considered part of both the valve pick system 310 and the valve control system 308. The second main switch 414 ensures that substantially all of the picking voltage is directed from the pick circuit 424 to the main valve 312. The first main switch 412 and the second main switch 414 are MOSFETS with internal body diodes. The first main switch 412 has an internal body diode with its cathode pointed toward the thermoelectric generator 402. The second main switch 414 has its body diode with the cathode pointed toward the main valve 312 (and away from the first main switch 412). Without the second main switch 414, when the pick switch 422 is turned ON, the pick voltage would appear on the main valve 312 and simultaneously on the first main switch 412. Even with the first main switch 412 turned off, the 3 to 5V pick spike may be sufficient to forward bias the internal body diode of first main switch 412, allowing current to flow through the first main switch 412 to discharge through the thermoelectric generator 402 source resistance to ground. This could have an adverse effect on the thermoelectric generator 402 and it is a loss of power that could be used for picking the main valve 312. The second main switch 414, however, has its internal body diode oriented opposite of the first main switch 412. When the second main switch 414 is off, the pick voltage reverse biases the internal body diode of the second main switch 414, preventing the flow of current to the thermoelectric generator 402 and permitting substantially all of the pick current to travel to the main valve 312. Alternatively, the second main switch 414 may be eliminated and the first main switch 412 may be oriented as the second main switch 414, i.e., with its internal body diode's cathode pointed toward the main valve 312 and its anode toward the thermoelectric generator 402. In such an embodiment, the first main switch's body diode will be reverse biased by the pick voltage and substantially all of the pick current travels to the main valve 312.

When it is determined that picking of the main valve 312 will occur, the main charge pump 416 is activated for 30 ms and first main switch 412 is turned on. The controller 306 will then go to sleep for 2 seconds to conserve power to let the voltage on the pick circuit capacitor rise. Upon waking at t=0 ms, the controller 306 turns on the pick switch 422. The pick circuit capacitor's voltage will begin decaying and current begins flowing through the main coil of the main valve 312. As the current through the main coil increases the main valve 312 will eventually open. At a time between about t=20 ms and t=30 ms (depending on the main valve's specific coils) the voltage from the pick circuit capacitor is close to zero. The second main switch 414 is turned on to couple the thermoelectric generator 402 output voltage to the main valve 312 to hold the valve 312 open. At t=30 ms, the pick switch 422 is turned off. At t=30 ms to 60 ms, the controller provides a PWM burst to the main charge pump 416 to keep the voltage V4 sufficient to keep the first main switch 412 turned on.

FIGS. 6-9 are diagrams of example embodiments in which inductive actuator coils of main valve 312 and/or pilot valve 314 are used as inductors for power converters. In some embodiments, the inductive coils are used to form a boost converter to provide a boosted voltage for charging a picking capacitor. Some embodiments also use the boosted voltage to power other components of the control system. In some embodiments, the pilot valve coil is used, additionally or alternatively, as an inductor for Colpitts converter 404.

Figure 6:
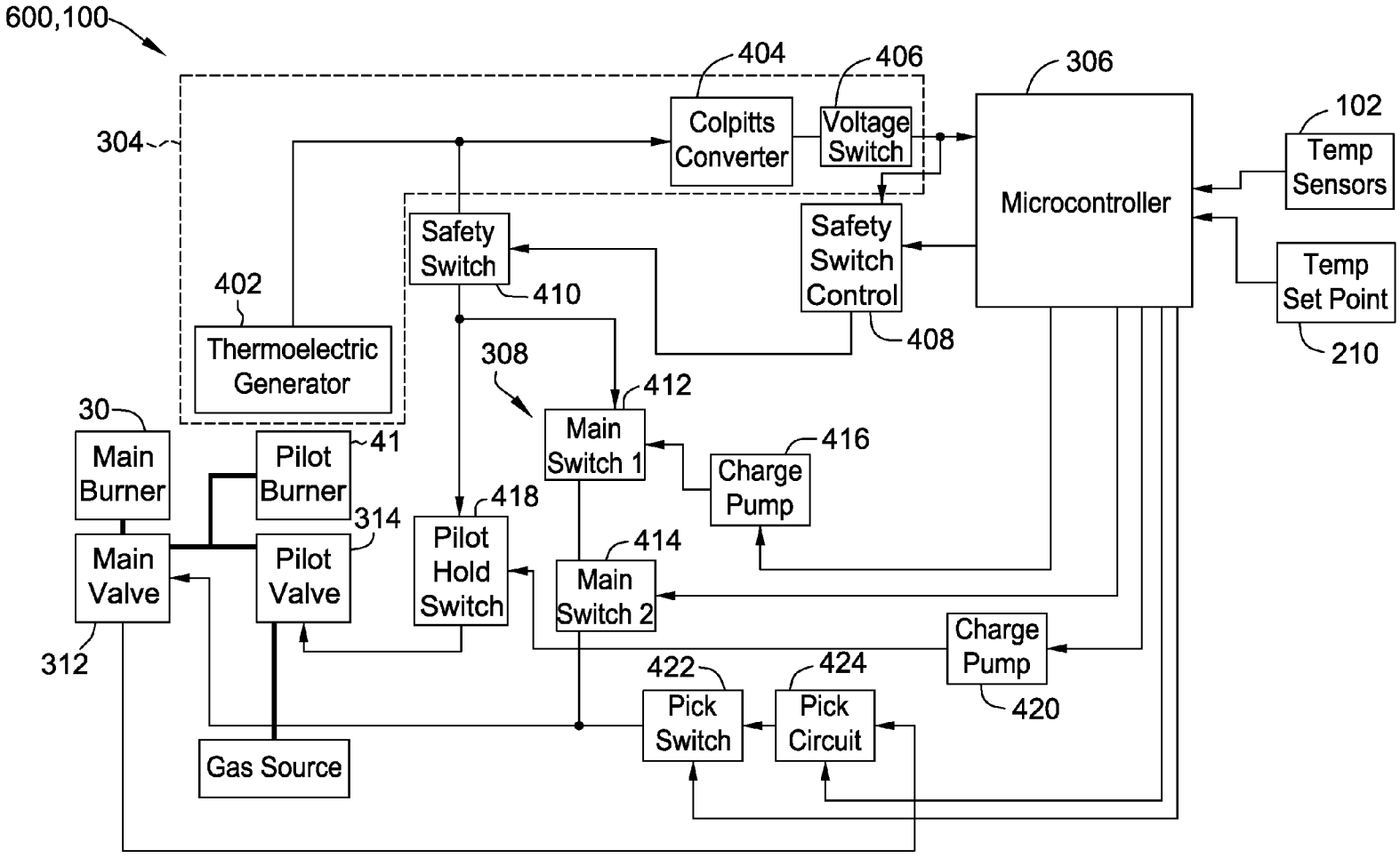
FIG. 6 is a schematic block diagram block of another embodiment of the control system shown in FIG. 3.

FIG. 6 is a block diagram of an example embodiment 600 of the control system 100 shown in FIG. 3. Except as otherwise described herein, the power system 304, the safety system 302, and the valve control system 308 in control system 600 are substantially the same as the power system 304, the safety system 302, and the valve control system 308 in control system 400 (shown in FIG. 4) and operate in substantially the same manner. Description of these common subsystems will not be repeated.

In system 600, the valve pick system 310 is not directly connected to the output of the thermoelectric generator 402. Rather, the valve pick system receives the power to pick open the main valve 312 through the valve control system, which is connected to the thermoelectric generator 402 via the safety switch 410. The output of the thermoelectric generator 402 is coupled to the pick circuit 424 through the main valve 312 actuator by the main switches 412 and 414. The main valve 312 actuator is a solenoid actuator with a coil (not shown). The pick circuit 424 uses the coil of main valve 312 as a part of the pick circuit 424 to charge a pick capacitor (not shown) to a voltage sufficient to open the main valve 312. More particularly, the coil of the main valve 312 is used as an inductor in a DC/DC power converter formed by the pick circuit 424. The controller 306 operates the DC/DC converter (i.e., it operates the pick circuit 424) to boost the voltage V1 output by the thermoelectric generator 402 to a larger voltage V5. The voltage V5 is about the same as the voltage V2. Alternatively, the voltage V5 is any other voltage sufficient to charge the pick capacitor sufficiently to pick open the main valve 312. In the example embodiment, the DC/DC converter is a switch mode boost converter. In other embodiments, the DC/DC converter is any other suitable switched or unswitched DC/DC converter.

Figure 7:
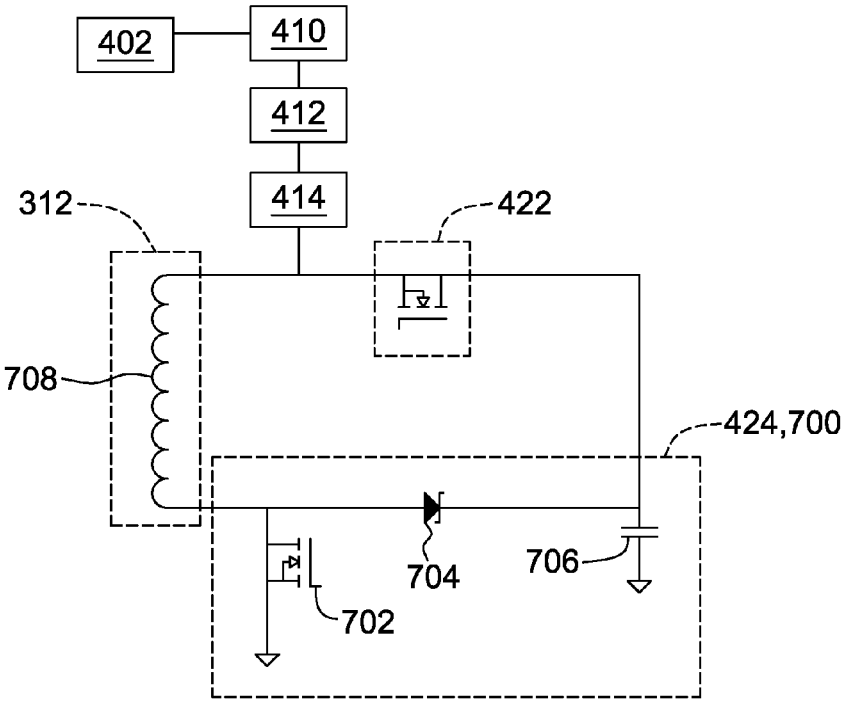
FIG. 7 is a partial circuit diagram of pick circuit for the control system shown in FIG. 6.

FIG. 7 is a partial circuit diagram including an example embodiment of a pick circuit 700 for use as the pick circuit 424 in the system 600 shown in FIG. 6. The pick circuit 700 includes a boost switch 702, a diode 704, and a pick capacitor 706. In the example embodiment, the boost switch 702 is a MOSFET, the diode 704 is a Schottky diode, and the pick capacitor 706 is a 680 microfarad capacitor. The main valve 312 includes a coil 708. In the example embodiment, the coil 708 has a nominal inductance of 85 mH. Alternatively, coil 708 may have any other suitable inductance, including a larger or a smaller inductance. The coil 708, the boost switch 702, the diode 704, and the pick capacitor 706 form a DC/DC boost converter. In operation, a voltage is applied to the coil 708 and the boost switch 702 is switched at a high frequency with an on/off duty cycle less than one (always on) and greater than zero (always off). An output voltage V5 greater than the input voltage V1 applied to the coil 708 is generated across the pick capacitor 706 and the pick capacitor is eventually charged to, ideally, V5. The controller 306 controls switching of the boost switch 702 using pulse width modulated (PWM) signals according to any suitable known control scheme for a DC/DC boost converter.

With reference to FIGS. 6 and 7, the pick circuit 424, the pick switch 422, and both main valve switches 412 and 414 are utilized for picking open the main valve 312. Pick switch 422 is held open and the controller 302 closes both main valve switches 412 and 414 to couple the voltage V1 from the thermoelectric generator 402 to the coil of the main valve 312 and the pick circuit 424. The current from the thermoelectric generator 402 flowing through the coil of main valve 312 is insufficient to open the main valve 312. The controller 302 sends PWM control signals to the pick switch 702 to cause the pick circuit 700 to boost the voltage V1 received from thermoelectric generator to the higher voltage V5 to charge the pick capacitor 706. The pick capacitor 706 will take time to charge. The controller 306 monitors the voltage of the pick capacitor.

When the pick capacitor is charged to a voltage greater than a picking threshold voltage, the controller 306 may pick open the main valve 312. The picking threshold voltage is less than the voltage V5, but more than the minimum voltage needed to open the main valve 312. In the example embodiment, the picking threshold voltage to which the pick capacitor is charged is about 3 volts. To pick the main valve 312, the controller turns off the second main switch 414 to ensure that the pick capacitor 706 discharges across the main valve 312. The controller 306 stops sending PWM signals to the boost switch 706 and turns on boost switch 706 (constantly on) to provide a ground path for the main valve 312 coil 708. The controller 306 then turns the pin connected to the pick switch 422 to a high output in order to activate the pick switch 422. The energy stored in the pick circuit capacitor is coupled to the main valve 312 through the pick switch 422 and the main valve 312 opens. The second main switch 414 is closed shortly before the pick switch 422 is opened. Closing the second main switch 414 couples the thermoelectric generator 402 voltage V1 to the main valve 312 through the first and second main switches 412 and 414 to hold the main valve 312 open so the main burner 30 remains lit.

The second main switch 414 is used in both picking and holding open the main valve 312 and can be considered part of both the valve pick system 310 and the valve control system 308. The second main switch 414 ensures that substantially all of the picking voltage is directed from the pick circuit 424 to the main valve 312. The first main switch 412 and the second main switch 414 are MOSFETs with internal body diodes. The first main switch 412 includes an internal body diode with its cathode pointed toward the thermoelectric generator 402. The second main switch 414 includes a body diode with the cathode pointed toward the main valve 312 (and away from the first main switch 412). In contrast, without the second main switch 414, when the pick switch 422 is turned ON, the pick voltage would be on the main valve 312 and simultaneously on the first main switch 412. Even with the first main switch 412 turned off, the 3 to 5V pick spike may be sufficient to forward bias the internal body diode of first main switch 412, allowing current to flow through the first main switch 412 to discharge through the thermoelectric generator 402 source resistance to ground. This could have an adverse effect on the thermoelectric generator 402, and it is a loss of power that could be used for picking the main valve 312. The second main switch 414, however, has its internal body diode oriented opposite of the first main switch 412. When the second main switch 414 is off, the pick voltage reverse biases the internal body diode of the second main switch 414, preventing the flow of current to the thermoelectric generator 402 and permitting substantially all of the pick current to travel to the main valve 312. Alternatively, the second main switch 414 may be eliminated and the first main switch 412 may be oriented as the second main switch 414, i.e., with its internal body diode's cathode pointed toward the main valve 312 and its anode toward the thermoelectric generator 402. In such an embodiment, the first main switch's body diode will be reverse biased by the pick voltage and substantially all of the pick current travels to the main valve 312.

Figure 8:
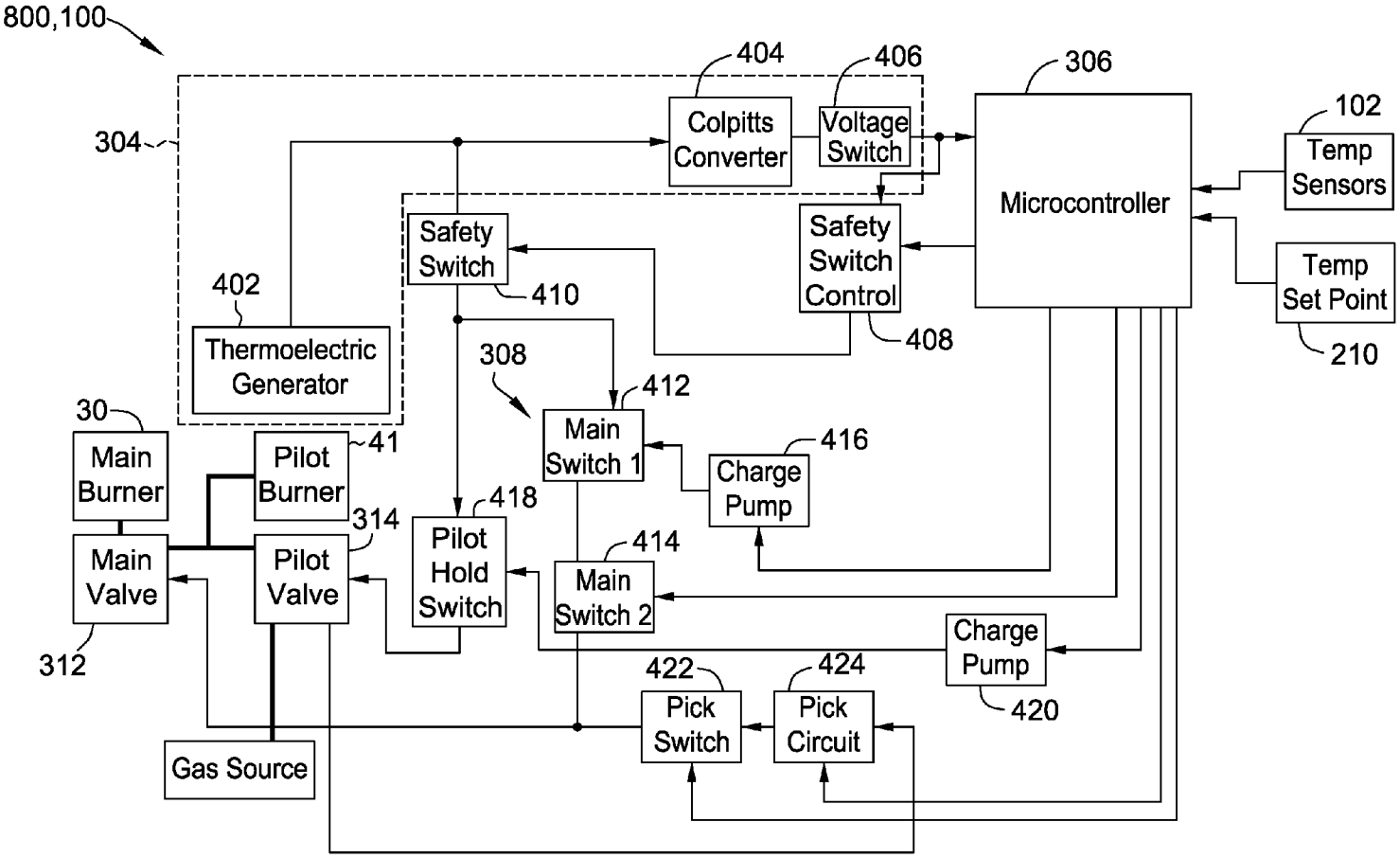
FIG. 8 is a schematic block diagram block of another embodiment of the control system shown in FIG. 3.

FIG. 8 is a block diagram of an example embodiment 800 of the control system 100 shown in FIG. 3. Except as otherwise described herein, the components of control system 800 are substantially the same as in control system 600 (shown in FIGS. 6 and 7) and operate in substantially the same manner.

In system 800, the valve pick system 310 is not directly connected to the output of the thermoelectric generator 402. Rather, the valve pick system receives the power to pick open the main valve 312 through the valve control system 308, which is connected to the thermoelectric generator 402 via the safety switch 410. The output of the thermoelectric generator 402 is coupled to the pick circuit 424 through the pilot valve 314. The pilot valve 314 actuator is a solenoid actuator with a coil (not shown in FIG. 8). The pick circuit 424 uses the coil of pilot valve 314 as a part of the pick circuit 424 to charge a pick capacitor (not shown in FIG. 8) to a voltage sufficient to open the main valve 312. More particularly, the coil of the main valve 312 is used as an inductor in a DC/DC power converter formed by the pick circuit 424. The controller 306 operates the DC/DC converter (i.e., it operates the pick circuit 424) to boost the voltage V1 output by the thermoelectric generator 402 to a larger voltage V5. The voltage V5 is about the same as the voltage V2. Alternatively, the voltage V5 is any other voltage sufficient to charge the pick capacitor sufficiently to pick open the main valve 312. In the example embodiment, the DC/DC converter is a switch mode boost converter. In other embodiments, the DC/DC converter is any other suitable switched or unswitched DC/DC converter.

Figure 9:
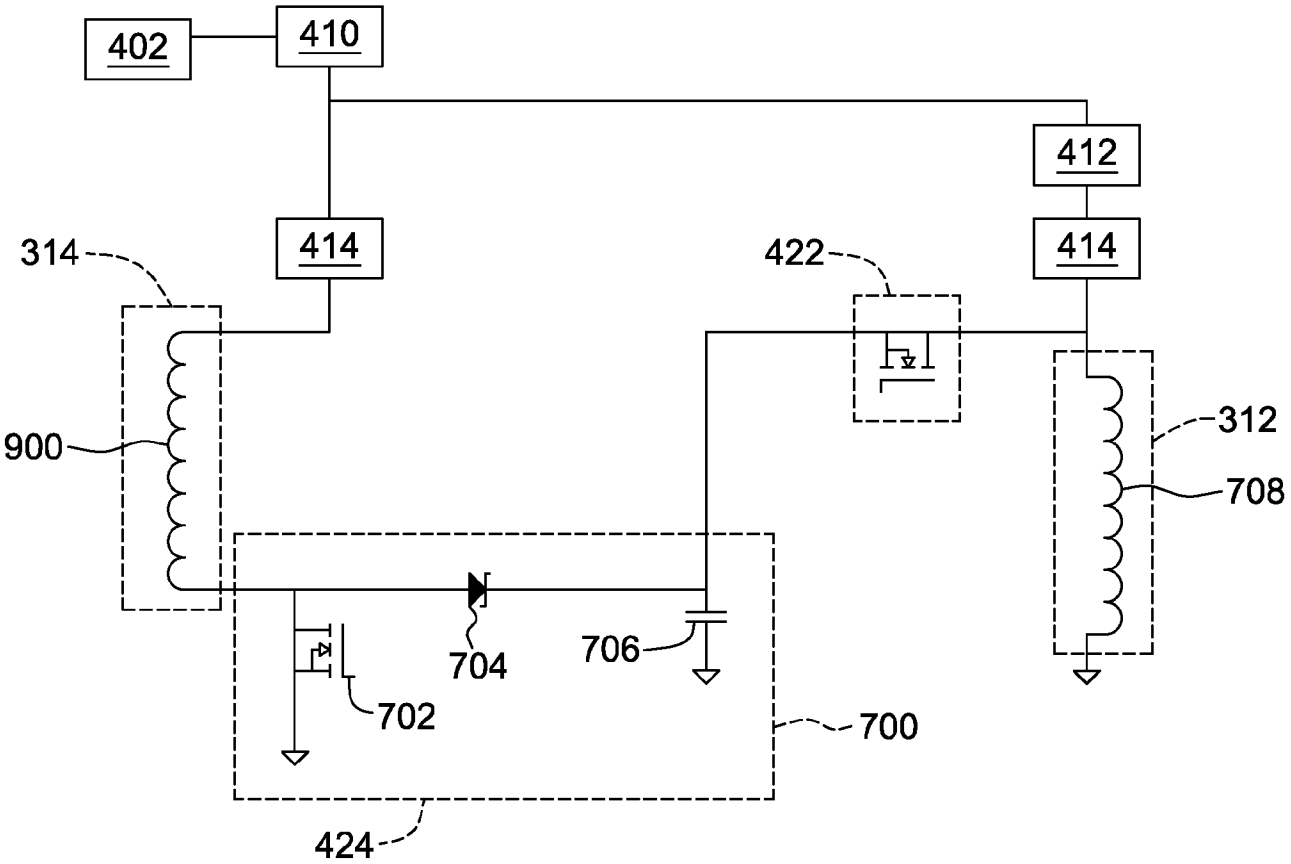
FIG. 9 is a partial circuit diagram of pick circuit for the control system shown in FIG. 8.

FIG. 9 is a partial circuit diagram including the pick circuit 700 for use as the pick circuit 424 in the system 800 shown in FIG. 8. The pilot valve 314 includes coil 900. Coil 900 may have any suitable inductance, including for example 85 mH. The coil 900, the boost switch 702, the diode 704, and the pick capacitor 706 form a DC/DC boost converter. In operation, a voltage is applied to the coil 900 through the pilot hold switch 418 and the boost switch 702 is switched at a high frequency with an on/off duty cycle less than one (always on) and greater than zero (always off). An output voltage V5 greater than the input voltage V1 applied to the coil 900 is generated across the pick capacitor 706 and the pick capacitor is eventually charged to, ideally, V5. The controller 306 controls switching of the boost switch 702 using pulse width modulated (PWM) signals according to any suitable known control scheme for a DC/DC boost converter.

With reference to FIGS. 8 and 9, the pick circuit 424, the pick switch 422, and both main valve switches 412 and 414 are utilized for picking open the main valve 312. Pick switch 422 and switches 412 and 414 are held open by controller 302. Pilot hold switch 418, which is generally closed/conducting at all times when the system is operating (unless pilot flame is lost), couples the voltage V1 from the thermoelectric generator 402 to the pilot valve coil 900 and the pick circuit 424. The controller 302 sends PWM control signals to the pick switch 702 to cause the pick circuit 700 to boost the voltage V1 received from thermoelectric generator to the higher voltage V5 to charge the pick capacitor 706. The pick capacitor 706 will take time to charge. The controller 306 monitors the voltage of the pick capacitor. When the pick capacitor is charged to a voltage greater than a picking threshold voltage, the controller 306 may pick open the main valve 312 as described above.

Embodiments of the methods and systems described herein achieve superior results compared to prior methods and systems. The larger pick capacitor embodiments use the relatively low voltage produced by a thermoelectric generator to pick open a main valve without needing a separate power converter to increase the voltage output by the thermoelectric generator. This may reduce the size and cost of the control system. Moreover, eliminating an extra power converter may reduce the number of heat generating components in the control system, thereby decreasing the amount of thermal dissipation required and decreasing problems caused by excessive component temperatures in the control system. Furthermore, the example embodiments that use the main valve coil or the pilot valve coil as an inductor in a power converter provide a higher voltage for use in picking the main valve with fewer components than some known systems with a separate boost converter. The valve coil serves the dual purposes of a component in the valve actuator and the DC/DC converter used to produce the voltage for actuating the valve. These embodiments provide faster capacitor charging than some known systems because of the boosted voltage. Additionally, the systems make larger voltages available than some known systems. The example embodiments that use the pilot valve coil as the inductor in a converter also benefit from the fact that the pilot hold switch generally remains switched on at all times when the control system is on. Thus, output voltage from the thermoelectric generator is generally available to be boosted via the pilot valve coil at any time. Moreover, the DC/DC converter formed with the pilot valve coil may be used to provide a boosted voltage to other components of the system when the main valve is not being picked.

Example embodiments of systems and methods for controlling a water heater are described above in detail. The system is not limited to the specific embodiments described herein, but rather, components of the system may be used independently and separately from other components described herein. For example, the controller and processor described herein may also be used in combination with other systems and methods, and are not limited to practice with only the system as described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

What is claimed is:

1. A control system for controlling a gas powered water heater to produce hot water in a storage tank by burning gas at a main burner, the control system comprising:

a thermoelectric generator to provide an electrical power output at a first voltage;

a valve control system configured to be coupled to a main gas valve and to selectively hold the main gas valve in an open position using the electrical power at the first voltage to provide gas to a main burner;

a valve pick system configured to be coupled to the main gas valve and to selectively pick the main gas valve from a closed position to the open position using the electrical power at the first voltage;

a power converter coupled to the thermoelectric generator to produce a boosted electrical power at a second voltage greater than the first voltage;

a controller coupled to the power converter and electrically powered by the boosted electrical power at the second voltage, the controller communicatively coupled to the valve control system and the valve pick system, the controller configured to control operation of the main burner and the main gas valve using the valve control system and the valve pick system to provide water heated to a setpoint temperature;

wherein the valve pick system comprises a valve pick circuit including a pick capacitor and the pick capacitor is charged with the thermoelectric generator's electrical power output at the first voltage; and wherein the valve pick system further comprises a pick charging switch coupled between the pick capacitor and the thermoelectric generator, and wherein the controller is configured to control the pick charging capacitor to selectively charge the pick capacitor with the thermoelectric generator's electrical power output at the first voltage.

2. The control system of claim 1, wherein the pick capacitor has a capacitance greater than 5000 microfarads.

3. The control system of claim 1, wherein the first voltage is less than a minimum picking voltage rating of the main gas valve.

4. A control system for controlling a gas powered water heater to produce hot water in a storage tank by burning gas at a main burner, the control system comprising:

a thermoelectric generator to provide an electrical power output at a first voltage;

a valve control system configured to be coupled to a main gas valve and to selectively hold the main gas valve in an open position using the electrical power at the first voltage to provide gas to a main burner;

a valve pick system configured to be coupled to the main valve to selectively pick the main gas valve from a closed position to the open position, the valve pick system including a pick capacitor, the valve pick system configured to be coupled to receive the thermoelectric generator's electrical power output at the first voltage through the valve control system and to charge the pick capacitor to a second voltage greater than the first voltage;

a power converter coupled to the thermoelectric generator to produce a boosted electrical power at a third voltage greater than the first voltage;

a controller coupled to the power converter and electrically powered by the boosted electrical power at the third voltage, the controller communicatively coupled to the valve control system and the valve pick system, the controller configured to control operation of the main burner and the main gas valve using the valve control system and the valve pick system to provide water heated to a setpoint temperature; and wherein the main gas valve comprises an actuator coil coupled to the thermoelectric generator through the valve control system, the pick system comprises a boost switch coupled between the actuator coil and ground, and a diode coupled between the boost switch and the pick capacitor.

5. The control system of claim 4, wherein the actuator coil, the boost switch, the diode, and the pick capacitor are coupled together to form a direct current (DC) to DC boost converter.

6. The control system of claim 5, wherein the controller is configured to provide pulse width modulated (PWM) control signals to the boost switch to operate the pick circuit and the actuator coil to charge the pick capacitor to the second voltage.

7. The control system of claim 6, wherein the controller is configured to stop providing PWM control signals to the boost switch and to close the boost switch when the controller determines to pick the main valve.

8. The control system of claim 7, wherein the valve pick system includes a pick switch configured to be coupled between the pick capacitor and the actuator coil, and the controller is configured to open the pick switch when charging the pick capacitor and to close the pick switch when the controller determines to pick the main valve.

9. The control system of claim 4, wherein the valve control system is further configured to be coupled to a pilot valve and to selectively hold the pilot valve in an open position using the electrical power at the first voltage, and wherein the pilot valve comprises a second actuator coil coupled to the thermoelectric generator through the valve control system.

10. The control system of claim 9, wherein the actuator coil, the boost switch, the diode, and the pick capacitor are coupled together to form a direct current (DC) to DC boost converter.

11. A water heater comprising:

a storage tank;

a main burner configured to burn gas to heat water in the storage tank;

a main gas valve coupled to the main burner and having an open position permitting gas flow through the main gas valve and a closed position preventing gas flow through the main gas valve, the main gas valve including an actuator coil;

a pilot burner configured to ignite gas burned by the main burner;

a pilot valve coupled to the pilot burner and having an open position permitting gas flow through the pilot valve and a closed position preventing gas flow through the pilot valve, the pilot valve including a pilot actuator coil; and a control system configured to control operation of the main burner and the pilot to provide water in the storage tank substantially at a setpoint temperature, the control system comprising:

a thermoelectric generator to provide an electrical power output at a first voltage;

a valve control system coupled to the main gas valve and the pilot valve, the valve control system configured to selectively hold the main gas valve in an open position using the electrical power at the first voltage to provide gas to the main burner and to selectively hold the pilot valve in an open position using the electrical power at the first voltage to provide gas to the pilot burner a valve pick system coupled to the main valve to selectively pick the main gas valve from a closed position to the open position, the valve pick system including a pick capacitor, the valve pick system coupled to receive the thermoelectric generator's electrical power output at the first voltage through the valve control system, the valve pick system configured to charge the pick capacitor to a second voltage greater than the first voltage;

a power converter coupled to the thermoelectric generator to produce a boosted electrical power at a third voltage greater than the first voltage;

a controller coupled to the power converter and electrically powered by the boosted electrical power at the third voltage, the controller communicatively coupled to the valve control system and the valve pick system, the controller configured to control operation of the main burner and the main gas valve using the valve control system and the valve pick system to provide water heated to a setpoint temperature; and wherein the main gas valve comprises an actuator coil coupled to the thermoelectric generator through the valve control system, the pick system comprises a boost switch coupled between the actuator coil and ground, and a diode coupled between the boost switch and the pick capacitor.

12. The water heater of claim 11, wherein the actuator coil, the boost switch, the diode, and the pick capacitor are coupled together to form a direct current (DC) to DC boost converter.

13. The water heater of claim 11, wherein the controller is configured to provide pulse width modulated (PWM) control signals to the boost switch to operate the pick circuit and the actuator coil to charge the pick capacitor to the second voltage.

14. The water heater of claim 13, wherein the controller is configured to stop providing PWM control signals to the boost switch and to close the boost switch when the controller determines to pick the main valve.

15. The water heater of claim 14, wherein the valve pick system includes a pick switch coupled between the pick capacitor and the actuator coil, and the controller is configured to open the pick switch when charging the pick capacitor and to close the pick switch when the controller determines to pick the main valve.

16. The water heater of claim 11, wherein the pilot actuator coil is selectively coupled to the thermoelectric generator through the valve control system.

17. The water heater of claim 16, wherein the pilot actuator coil, the boost switch, the diode, and the pick capacitor are coupled together to form a direct current (DC) to DC boost converter.

18. A water heater comprising:

a storage tank;

a main burner configured to burn gas to heat water in the storage tank;

a main gas valve coupled to the main burner and having an open position permitting gas flow through the main gas valve and a closed position preventing gas flow through the main gas valve, the main gas valve including an actuator coil;

a pilot configured to ignite gas burned by the main burner; and a control system configured to control operation of the main burner and the pilot to provide water in the storage tank substantially at a setpoint temperature, the control system comprising:

a thermoelectric generator to provide an electrical power output at a first voltage;

a valve control system coupled to the main gas valve and configured to selectively hold the main gas valve in an open position using the electrical power at the first voltage to provide gas to the main burner;

a valve pick system coupled to the main gas valve and configured to selectively pick the main gas valve from a closed position to the open position using the electrical power at the first voltage;

a power converter coupled to the thermoelectric generator to produce a boosted electrical power at a second voltage greater than the first voltage;

a controller coupled to the power converter and electrically powered by the boosted electrical power at the second voltage, the controller communicatively coupled to the valve control system and the valve pick system, the controller configured to control operation of the main burner and the main gas valve using the valve control system and the valve pick system to provide water heated to a setpoint temperature;

wherein the valve pick system comprises a valve pick circuit including a pick capacitor and the pick capacitor is charged with the thermoelectric generator's electrical power output at the first voltage; and wherein the valve pick system further comprises a pick charging switch coupled between the pick capacitor and the thermoelectric generator, and wherein the controller is configured to control the pick charging capacitor to selectively charge the pick capacitor with the thermoelectric generator's electrical power output at the first voltage.

* * * * *